US007924129B2

(12) United States Patent
Skinner et al.

(10) Patent No.: US 7,924,129 B2
(45) Date of Patent: Apr. 12, 2011

(54) IGNITION COIL WITH SPRING-LOADED BOLTLESS MOUNTING TO SPARK PLUG

(75) Inventors: Albert A. Skinner, El Paso, TX (US); Mark A. Paul, El Paso, TX (US); Andre V. Scaff, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 479 days.

(21) Appl. No.: 12/070,672

(22) Filed: Feb. 20, 2008

(65) Prior Publication Data

US 2009/0205621 A1 Aug. 20, 2009

(51) Int. Cl.

| | |
|---|---|
| ***H01F 27/02*** | (2006.01) |
| ***H01F 38/12*** | (2006.01) |
| ***F02P 35/00*** | (2006.01) |
| ***H01R 11/22*** | (2006.01) |

(52) U.S. Cl. ..... 336/90; 123/634; 123/647; 439/816

(58) Field of Classification Search ..... 336/90; 123/634, 647; 439/816

See application file for complete search history.

(56) References Cited

U.S. PATENT DOCUMENTS

2006/0091987 A1 * 5/2006 Skinner et al. ..... 336/90

* cited by examiner

*Primary Examiner* — Anh T Mai
*Assistant Examiner* — Ronald W Hinson
(74) *Attorney, Agent, or Firm* — Thomas N. Twomey

(57) ABSTRACT

An ignition coil engages an inner surface of a bore of an engine, the providing access to a spark plug. The engagement is a boltless cam-lock engagement. A spring is associated with the engagement to hold the assembly in tension, and the spring also contacts a ground terminal in the ignition coil and the base of the spark plug to provide a short electrical path for radiofrequency interference (RFI) dissipation.

17 Claims, 1 Drawing Sheet

IGNITION COIL WITH SPRING-LOADED BOLTLESS MOUNTING TO SPARK PLUG

I. FIELD OF THE INVENTION

The present invention relates to vehicle ignition coils.

II. BACKGROUND OF THE INVENTION

Ignition coils are components that use the coupling between a primary winding and a secondary winding to transform relatively low voltages from the battery into high voltages that are supplied to the spark plugs in vehicle gasoline engines. The spark plugs start the internal combustion process that drives the rods and hence, crankshaft and axles. In older systems, a single ignition coil is provided, and a distributor sends the pulses from the coil through respective high voltage spark plug wires to the spark plugs in the cylinders in accordance with a timing that is established by the distributor.

In relatively modern engines, an engine can have several ignition coils, one for each cylinder or for each pair of cylinders, thereby advantageously eliminating the need for distributors and high voltage wires and also providing more precise control of the engine timing. One example of such an ignition coil system is set forth in U.S. Pat. No. 6,556,118, owned by the present assignee and incorporated herein by reference.

When such a coil is used to energize two spark plugs (either for two different cylinders or for a single cylinder in an engine that has two spark plugs per cylinder), two secondary windings surround the low voltage-carrying primary winding that is wound on an interior ferromagnetic core, with the secondary windings being radially spaced from the primary winding. Each secondary winding, owing to the inductive coupling between it and the primary winding and the different numbers of winding turns between the primary and secondary windings, produces a high voltage that is sent to a respective spark plug.

As also understood herein, it would be advantageous to ameliorate stray radiofrequency interference (RFI) transient signals that otherwise can be induced from spark plug operation, because RFI signals can undesirably interfere with other components in the vehicle.

SUMMARY OF THE INVENTION

An ignition coil has a core supporting a primary winding and one or more secondary windings inductively couplable to the primary winding. The secondary winding is associated with an electrical ground. A plastic case holds the windings and is associated with a generally cylindrical plug engagement fitting defining an axis. An elongated slit is formed through the fitting and has an elongated slit segment that is parallel to the axis, with the slit segment being configured for slidably receiving a protrusion associated with a bore of an engine to facilitate mechanical coupling of the case. Also, a generally ring-shaped electrically conductive terminal is disposed on the fitting and is electrically connected to the electrical ground. A spring is juxtaposed with the fitting and is configured to surround a boot of the spark plug. Per present principles, the terminal is oriented to electrically contact the spring and the spring is configured to electrically contact a base of the spark plug to establish an electrical path between the secondary winding and the base.

In another aspect, an ignition coil has a primary winding receiving voltage from a source of voltage in a vehicle and a secondary winding inductively couplable to the primary winding. A case holds the windings and is engageable in a cam lock engagement with a spark plug assembly. Also, a spring is associated with the cam lock engagement and establishes a path for electrical communication between the secondary winding and a spark plug of the spark plug assembly.

In still another aspect, an assembly includes a spark plug assembly including a boot and a spark plug, and an ignition coil mechanically coupled to the spark plug assembly using a boltless mounting. A spring that is associated with the boltless mounting electrically connects the base of the spark plug to an electrical ground associated with a secondary winding of the ignition coil.

The details of the present invention, both as to its structure and operation, can best be understood in reference to the accompanying drawings, in which like reference numerals refer to like parts, and in which:

DESCRIPTION OF THE PREFERRED EMBODIMENT

Figures 1, 2:
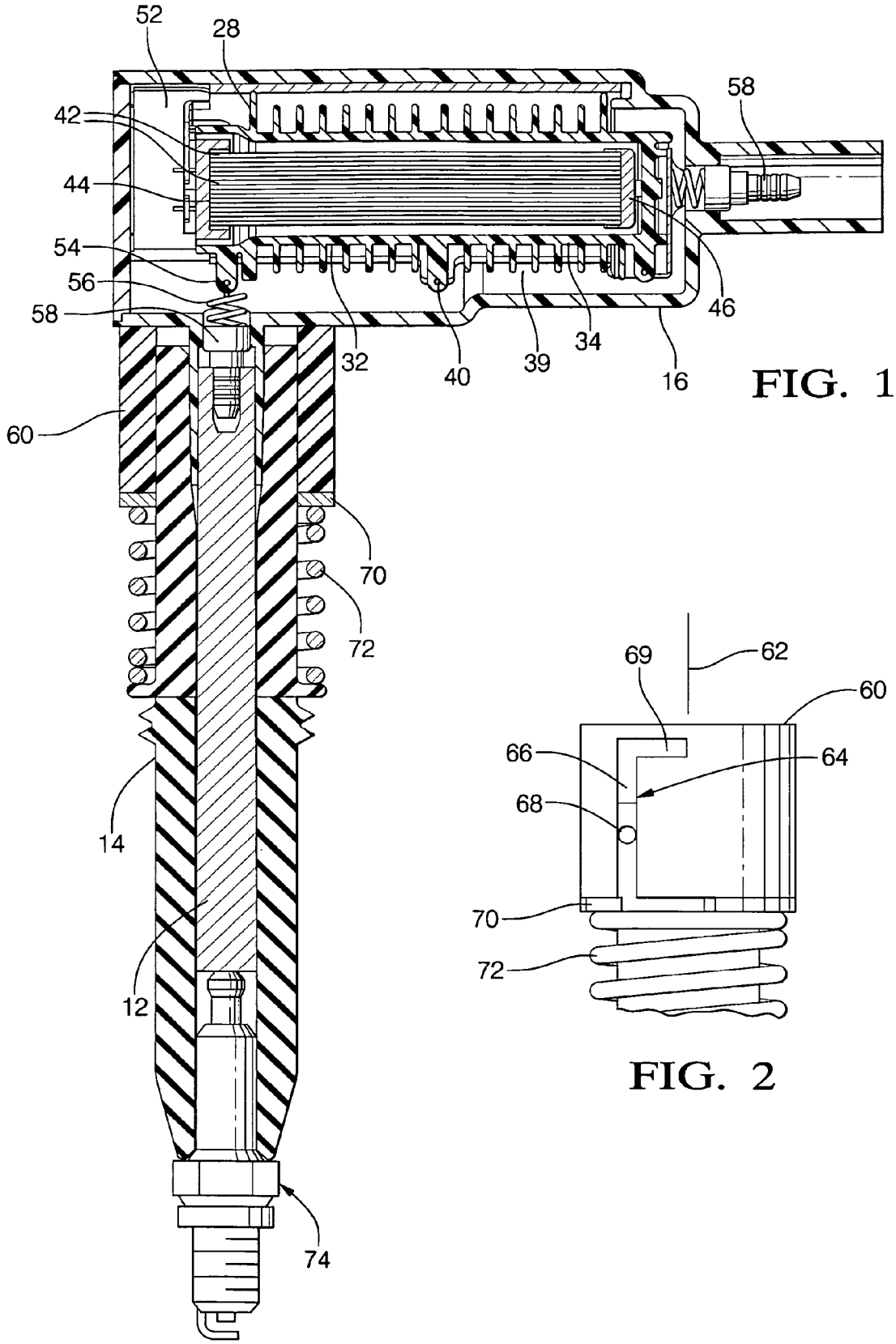
FIG. 1 is a side cross-sectional view showing the ignition coil, one of the spark plug boots, and the sleeve with grounding spring.
FIG. 2 is a cut-away side elevational view of the sleeve.

Referring initially to FIG. 1, an ignition coil is shown, generally designated 10, for use in energizing at least one spark plug (only a single spark plug 12 shown) that is disposed in a high voltage spark plug boot 14 and that extends into an engine cylinder in accordance with principles known in the art. The ignition coil 10 shown and described herein may be but one of plural coils that could be used to energize two spark plugs in an engine having more than two cylinders in a distributorless ignition system, i.e., no distributor exists between the ignition coil 10 and its spark plugs 12, although present principles are not limited to the specific coil 10 shown.

Accordingly and for purposes of illustrative disclosure, the ignition coil 10 may include various components including a secondary winding spool 28 that can bear first and second electrically conductive wire secondary windings 32, 34. In the non-limiting embodiment shown, the secondary windings 32, 34 can be in axial sequence to each other. The secondary windings 32, 34 may be wound oppositely to each other relative to the axial dimension of the coil 10. A dielectric material 39 such as epoxy may be disposed between the secondary winding spool 28 and the case 16. In any case, in non-limiting embodiments the secondary winding or windings can be connected to a secondary winding ground terminal 40, which may be established by one or more electrical conductors.

In accordance with ignition coil principles known in the art, a primary wire winding 42 is wound around a soft iron core 44 that is coaxially disposed within the secondary winding spool 28. The core 44, which may be made of silicon steel laminations or compression molded iron particles or other appropriate material, is bounded at its ends by a silicon or rubber buffer cup 46 and a primary cap.

It is to be understood that the primary winding 42 is electrically connected, via a connector member 52, to an ignition system that selectively energizes the primary winding 42 from a source of voltage such as a vehicle battery in accordance with ignition coil principles known in the art.

When the primary winding 42 is energized, the cooperation between the core 44, primary winding 42, and secondary windings 32, 34 results in inductive coupling between the primary winding 42 and secondary windings 32, 34. Owing to this coupling and to the different number of turns between primary and secondary, the relatively low battery voltage in the primary winding 42 is transformed into relatively higher voltages in the secondary windings 32, 34 for provision of the higher voltages to the spark plugs.

Thus, a power terminal 54 of, e.g., the secondary windings 32 can be connected to a respective spark plug using connector structure known in the art, e.g., the power terminal 54 may be electrically connected to an internal spring 56 with associated terminal cup 58.

In accordance with present principles and cross-referencing FIGS. 1 and 2, the ignition coil 10 may be formed with or attached to a rigid hollow generally cylindrical plug engagement fitting 60 defining an axis 62. As shown, an elongated L-shaped slit 64 is formed through the wall of the fitting 60 and has an elongated slit segment 66 that is parallel to the axis 62. The slit segment 66 is configured for slidably receiving a protrusion 68 that on the inner surface of a bore on the engine, with the bore providing access to the spark plug. The bore may be, without limitation, part of a cam cover or spark plug wall, the feature(s) on the engine in the area where the spark plug mounts to the engine. This facilitates mechanically coupling the coil assembly to the engine by a cam lock that is established when the coil assembly is rotated to move the protrusion into the end channel 69 of the slit 64.

As envisioned herein, a generally ring-shaped electrically conductive ground terminal 70 is disposed on the fitting 60 by, e.g., overmolding the fitting 60 on the terminal 70 or pressing the terminal 70 into the open end of the fitting as shown, or around an inside surface of the fitting. It is to be understood that the terminal 70 is electrically connected to the electrical ground terminal 40 of the secondary winding.

An external spring 72 is juxtaposed with the fitting 60 and is configured to surround the boot 14 in compression. The ground terminal 70 is oriented to electrically contact the spring 72. Also, the spring 72 electrically contacts the base 74 of the spark plug 12, and in this way establishes an electrical path between the secondary winding and the base of the spark plug. It may now be appreciated that the spring 72 both establishes a ground path from the spark plug as well as establishes a counter-force to secure the boltless mechanical coupling between the boot 14 and coil 14 afforded by the cooperation of the slit 64 and protrusion 68.

While the particular IGNITION COIL WITH SPRING-LOADED BOLTLESS MOUNTING TO SPARK PLUG is herein shown and described in detail, it is to be understood that the subject matter which is encompassed by the present invention is limited only by the claims.

What is claimed is:

1. An ignition coil, comprising:

at least one core supporting a primary winding;

at least one secondary winding inductively couplable to the primary winding, the secondary winding being associated with an electrical ground;

a plastic case holding the windings and associated with a generally cylindrical plug engagement fitting defining an axis, an elongated slit being formed through the fitting and having at least an elongated slit segment parallel to the axis, the slit segment being configured for slidably receiving a protrusion associated with an inner surface of a bore of an engine, the bore providing access to a spark plug;

a generally ring-shaped electrically conductive terminal disposed on the fitting and electrically connected to the electrical ground; and a spring juxtaposed with the fitting and configured to surround at least a boot associated with the spark plug, the terminal being oriented to electrically contact the spring, the spring being configured to electrically contact a base of the spark plug to establish an electrical path between the secondary winding and the base.

2. The coil of claim 1, wherein the terminal is disposed at an open end of the fitting.

3. The coil of claim 2, wherein the terminal is disposed around an inside surface of the open end of the fitting.

4. The coil of claim 1, wherein the slit is L-shaped.

5. The coil of claim 1, the spring being in compression.

6. An ignition coil, comprising:

at least one primary winding receiving voltage from a source of voltage in a vehicle; at least one secondary winding inductively couplable to the primary winding; a case holding the windings and engageable in a cam lock engagement with an inner surface of a bore of an engine, the bore providing access to a spark plug; and a spring being associated with the cam lock engagement and establishing a path for electrical communication between at least the secondary winding and the spark plug, wherein the secondary winding is associated with an electrical ground, the spring being electrically connected to the ground, wherein the case is formed with a generally cylindrical plug engagement fitting and the ignition coil comprises a generally ring-shaped electrically conductive terminal disposed on the fitting and electrically connected to the electrical ground.

7. The coil of claim 6, comprising at least one core supporting the primary winding.

8. The coil of claim 6, wherein the fitting defines an axis and an elongated slit is formed through the fitting and has at least an elongated slit segment parallel to the axis, the slit segment being configured for slidably receiving a protrusion associated with the bore facilitate mechanical coupling to the case.

9. The coil of claim 6, wherein the spring is juxtaposed with the fitting and is configured to surround at least a boot associated with the spark plug, the terminal being oriented to electrically contact the spring, the spring being configured to electrically contact a base of the spark plug to establish an electrical path between the secondary winding and the base.

10. The coil of claim 6, wherein the terminal is disposed at an open end of the fitting.

11. The coil of claim 6, wherein the terminal is disposed around an inside surface of the open end of the fitting.

12. The coil of claim 8, wherein the slit is L-shaped.

13. The coil of claim 6, the spring being in compression.

14. An assembly comprising:

at least one spark plug assembly including a boot and a spark plug associated therewith; and an ignition coil mechanically coupled to the spark plug assembly using a boltless mounting, a spring associated with the boltless mounting electrically connecting a base of the spark plug to an electrical ground associated with a secondary winding of the ignition coil, wherein the ignition coil comprises:

at least one core supporting a primary winding;

at least one secondary winding inductively couplable to the primary winding, the secondary winding being associated with an electrical ground;

a plastic case holding the windings and formed with a generally cylindrical plug engagement fitting defining an axis, an elongated slit being formed through the fitting and having at least an elongated slit segment parallel to the axis, the slit segment being configured for slidably receiving a protrusion associated with an inner surface of a bore of an engine, the bore providing access to a spark plug, the protrusion facilitating mechanically coupling the spark plug assembly to the case; and a generally ring-shaped electrically conductive terminal disposed on the fitting and electrically connected to the electrical ground.

15. The assembly of claim 14, wherein the spring is juxtaposed with the fitting and is configured to surround at least the boot of the spark plug assembly, the terminal being oriented to electrically contact the spring, the spring being configured to electrically contact the base of the spark plug to establish an electrical path between the secondary winding and the base.

16. The coil of claim 14, wherein the terminal is disposed around an inside surface of the open end of the fitting.

17. The coil of claim 14, wherein the slit is L-shaped.

* * * * *